United States Patent [19]

Morton

[11] 4,325,006

[45] Apr. 13, 1982

[54] HIGH PULSE REPETITION RATE COAXIAL FLASHLAMP

[75] Inventor: Richard G. Morton, Richland, Wash.

[73] Assignee: Jersey Nuclear-AVCO Isotopes, Inc., Bellevue, Wash.

[21] Appl. No.: 62,635

[22] Filed: Aug. 1, 1979

[51] Int. Cl.[3] ..... H05B 41/34; H01J 61/52

[52] U.S. Cl. ..... 315/112; 313/22; 313/220; 372/35

[58] Field of Search ..... 315/111.1, 112; 313/17, 313/22, 220, 231.7; 331/94.5 P

[56] References Cited

U.S. PATENT DOCUMENTS

| | | | |
|---|---|---|---|
| 2,972,698 | 2/1961 | Dana et al. | 313/231 |
| 3,262,004 | 7/1966 | Keller | 331/94.5 P X |
| 3,311,769 | 3/1967 | Schmidtlein | 313/32 |
| 3,337,763 | 8/1967 | Aronson et al. | 313/22 |
| 3,337,764 | 8/1967 | Menown et al. | 313/30 |
| 3,366,815 | 1/1968 | Anderson | 313/32 |
| 3,510,801 | 5/1970 | Mastrup | 331/94.5 P |
| 3,521,103 | 7/1970 | Nakamura et al. | 313/32 |
| 3,541,371 | 11/1970 | Legros et al. | 313/32 |
| 3,603,827 | 9/1971 | Degawa et al. | 313/24 |
| 3,619,682 | 11/1971 | Lo et al. | 313/22 |
| 3,643,174 | 2/1972 | Zeidler | 313/22 X |
| 3,651,358 | 3/1972 | Trove | 313/12 |
| 3,736,451 | 5/1973 | Weninger | 313/32 |
| 3,816,784 | 6/1974 | Weninger | 313/22 X |

*Primary Examiner*—Eugene R. LaRoche
*Attorney, Agent, or Firm*—Weingarten, Maxham & Schurgin

[57] ABSTRACT

A coaxial flashlamp for pulsed operation at high repetition rates having an annular, light emitting discharge path between fluid cooled coaxially disposed, inner and outer optically transparent tubes. Electrodes are provided at opposite ends of the discharge paths and a gas such as Xenon is provided between the electrodes. The gas is discharged by confinement between the two tubes, forced to assume a dispersed shape which permits more efficient cooling at the discharge borders by fluid coolant inside the inner tube and around the outer tube.

9 Claims, 5 Drawing Figures

HIGH PULSE REPETITION RATE COAXIAL FLASHLAMP

FIELD OF THE INVENTION

This invention relates to flashlamps and more particularly, to flashlamps suitable for high pulse repetition rate optical pumping of liquid lasers.

BACKGROUND OF THE INVENTION

In the applications of lasers to isotope enrichment, particularly uranium enrichment as represented in U.S. Pat. Nos. 3,772,519 and 3,944,947. Very high repetition rate pulsed lasers are desired in order to increase the processing rate in which isotopes may be separated. To achieve high repetition rate laser pulses requires among other things high pulse rate flashlamps for excitation of the lasing medium, typically a flowing dye solution in this application. While pulse rates of substantially over a 100 pulses per second may be achieved with conventional flashlamps, rates approaching or exceeding 1,000 pulses per second result in a substantial elongation of the pulse duration which destroys the high pulse rate performance. The pulse elongation which occurs at high pulse rates appears to be due to the accumulation of energy within the discharged gas beyond that which is exhausted by radiation or conduction the accumulation being aggrevated at high pulse rate due to the increase energy applied to the gas by the more frequent application of electrical discharge potentials to the flashlamp electrodes.

SUMMARY OF THE INVENTION

A flashlamp construction according to the present invention provides a light emission pulse which, at high pulse rates, still follows the driving current pulse thus avoiding the elongated pulse tail characteristic of conventional flashlamps at high pulse rate. The flashlamp emission has been observed to retain this pulse shape at repetition rates up to and above one thousand pulses per second. The light pulse thus obtained is suitable for optical pumping of dye lasers at high repetition rates.

The flashlamp which is constructed according to the present invention achieves the above-stated objectives, by distributing the discharge path over an annular surface formed between a pair of inner and outer optically transparent, coaxially disposed tubes. The space between the tubes defines the discharge path and is filled with an appropriate light emitting gas such as Xenon. First and second electrodes close the space between the tubes at opposite axial ends. The annularly distributed discharge gas is pulse excited at a high repetition rate resulting in the creation of a high level of excess gas energization. The annular distribution of the light emitting medium disperses this excess energy so that it can be kept from impairing pulse fall time. For this purpose the inner tube is provided with a flow of coolant which establishes a cooled inner gas border of substantial area. Due to the annular discharge, the expanded area of cooling promotes more rapid gas cooling, which in turn prevents the optical pulse lengthening associated with conventional flashlamps at high repetition rate. Liquid is also circulated around the outside of the outer tube to provide a further enhancement of this cooling effect.

BRIEF DESCRIPTION OF THE DRAWINGS

These and other features of the present invention are more fully described below in the detailed description of a preferred embodiment, presented for purposes of illustration and not by way of limitation, and in the accompanying drawing in which.

DETAILED DESCRIPTION

Figures 1, 2A, 2B, 3A, 3B:
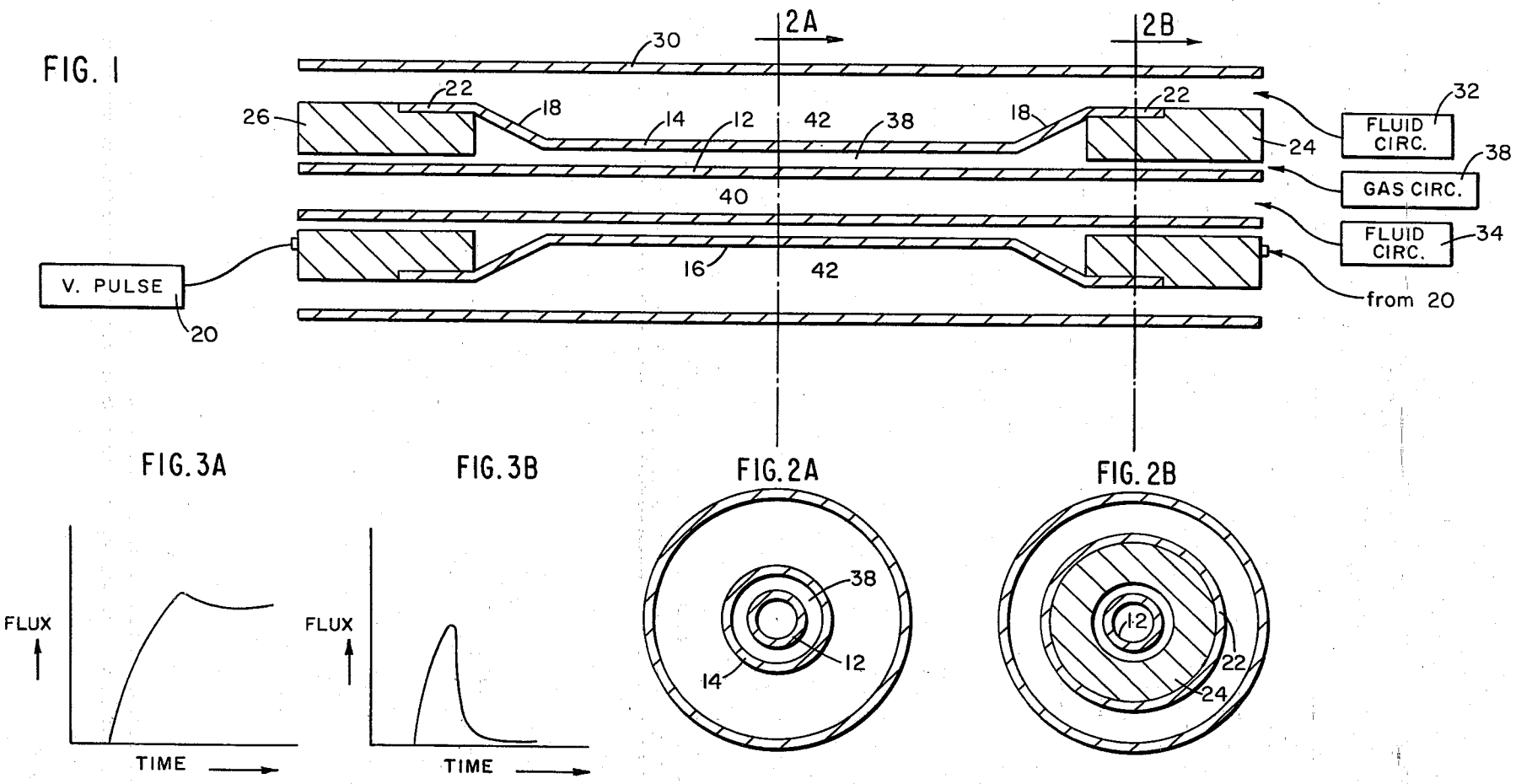
FIG. 1 is a longitudinal cross section of a preferred embodiment of the flashlamp of the present invention.
FIGS. 2A and B are radial cross sections of the flashlamp of FIG. 1 at an axial position intermediate the electrodes and at the electrodes respectively.
FIGS. 3A and 3B are wave form diagrams of flashlamp light emission for conventional flashlamps and the flashlamps of the present invention.

The present invention contemplates a flashlamp adapted for and operative at high pulse rates of light emission with well defined short pulses, particularly having a short fall time at pulse rates near or in excess of 1,000 pulses per second. The flashlamp of the present invention achieves these benefits by distributing the gas discharge path over an increased area in the form of an annular region. The annular geometry permits more efficient cooling of the discharge path by providing a greater surface area at the inner or outer boundaries of the discharge path, or both, in contact with the discharge medium. These inner and/or outer borders are cooled, promoting a rapid and efficient sink for excess energy in the discharged gas that would otherwise prolong the light pulse at high pulse rates.

While it is known to provide a flashlamp having the discharge gas confined between coaxial cylindrical surfaces, the effect of pulse elongation at high pulse rate and the elimination of this effect through the utilization of a cylindrical discharge path in combination with its more advantageously cooled shape has been found to produce an improvement in pulse repetition rate of approximately a factor of 10 without extension of pulse length, particularly important in high pulse repetition rate dye laser excitation applications.

The details of construction of a preferred embodiment of the invention are illustrated in the drawing. Referring first to FIG. 1, there is shown there a flashlamp according to the present invention. The flashlamp 10 is generally constructed of cylindrical elements, coaxial to a central axis and is of generally cylindrical form. A central quartz tube 12 is provided in the form of an extended cylinder. Typically, the central tube 12 is approximately 3 millimeters in inside diameter and 4 millimeters in outside diameter and extends approximately 12 to 18 inches in length. An outer quartz tube 14 is coaxially disposed about central tube 12. The outer tube 14 may, for example, have an inside diameter of approximately 5 millimeters and an outside diameter of approximately 7 millimeters, thus providing a separation of approximately ½ millimeter between the outer surface of the central tube 10 and the inner surface of the outer tube 14.

The outer tube 14 has end portions of greater diameter formed by gradually widening throat portions 18 and terminal, cylindrical tips 22. First and second annular electrodes 24 and 26 are set into opposite tips 22 of the tube 14 and sealed hermetically thereto. The electrodes 24 and 26 may be sealed to the central tube 12 to enclose and trap a gas between tubes 12 and 14, or a space may be left for refreshing of the gas generally at ends 22 of the outer tube.

The enclosed volume bounded by central and outer tubes 12 and 14 and first and second electrodes 24 and 26 is filled with an emitting gas, preferably xenon at partial atmospheric pressure of between about 50 and 500 torr. The xenon gas thus fills the annular spacing between the inner and outer tubes.

The hermetic seal between the tubes 12 and 14 and the electrodes 24 and 26 may be provided by conventional, non-conductibe epoxies or by other known quartz to metal seals.

The throat regions 18 of the outer tube 14 are preferably included to increase electrode surface area in contact with the emitting gas. The electrodes 24 and 26 are of conventional flashlamp electrode materials, such as a sputter-resistant tungsten (75%)-copper (25%) alloy, or barium oxide impregnated tungsten.

Flashlamp excitation is accomplished by applying a current pulse of appropriate energy at a pulse rate of, for example, over 200 Hz through the ionized medium. For this purpose, a pulse source 20 is connected to electrodes 24 and 26. Source 20 may be synchronized to desired lasing bursts as desired.

The central and outer tubes 12 and 14 are further enclosed within a coaxial, transparent quartz envelope 30, typically cylindrical tube having an inside diameter sufficient to accept the enlarged tips 22 of tube 14 within the envelope and to permit the circulation of a cooling fluid from a source 32 between the envelope 30 and tube 14.

A fluid circulating source 34 is also provided to circulate a cooling fluid through the interior of the central tube 12. In the case where the gas between the tubes 12 and 14 is refreshed a gas circulating source 36 is provided to apply fresh discharge gas between the electrode 24 and tube 12.

As can be seen from the construction of the flashlamp described above with reference to FIGS. 1, 2A and 2B, the light emitting discharge is distributed throughout a region 38 between the tubes 12 and 14 greatly increasing the surface area bordering the discharge both at the inner diameter of tube 14 and the outer diameter of tube 12. This greatly expanded surface area substantially reduces the thermal impedance between the energized discharge and light emitting region 38 and cooled regions 40 and 42 respectively within the tube 12 and between the tube 14 and envelope 30. The rate of heat removal from the discharge area is thus greatly expanded through this increase in surface area, and in the case where cooling from both the inner and outer perimeters of the discharge is provided effectively further increases by a factor of 2 the rate of heat removal.

The use of cooling both within and around the discharge zone 38 is preferable since it allows the flashlamp to be operated at a higher average power, taking into account the essential limitation of the quartz melting point for the tubes 12 and 14.

With respect now to FIGS. 3A and 3B there is illustrated wave form diagrams representative of the improvement in pulse rate obtainable with the flashlamp of the present invention. In FIG. 3A there is illustrated in a wave form 44 the effective pulse elongation at rep rates of approximately 200 Hz in a xenon discharge at conventional fractional atmosphere pressure. Illustrated in FIG. 3B is a wave form 46 showing a typical pulse shape using a flashlamp in accordance with the present invention and operated at pulse rates substantially in excess of 500 Hz. The time scale in both FIGS. 3A and 3B is approximately the same.

Typical operating parameters for the flashlamp of the present invention include average flashlamp energys of 0.5 to 2 joules per centimeter of flashlamp length and gas pressures of 50 to 500 torr.

The above described preferred embodiment is illustrative of the invention only, the true scope being as shown below in the claims.

What is claimed is:

1. A flashlamp for pulsed operation at high repetition rates comprising:

a hollow, optically transparent outer tube;

a hollow, optically transparent central tube, coaxial with and within said outer tube and defining between said outer and central tubes a cylindrical discharge path having inner and outer surfaces coextensive with the inner and outer surfaces of said outer and central tubes;

a gas along said discharge path and capable of electrical energization to a light emitting condition;

means for energizing said gas to emit pulses of light at a rate above 200 Hz, and an optically transparent envelope surrounding said outer tube and providing a conduit for coolant between itself and said outer tube.

means for cooling substantially the whole of at least said inner and outer surfaces by flowing a coolant through said central tube and between said envelope and outer tube thereby to shorten the fall time of the emitted light pulses.

2. The flashlamp of claim 1 wherein said cooling means produces a light pulse fall time of no greater than 2 micro seconds.

3. The flashlamp of claim 1 further including;

first and second electrodes between said central and outer tubes at axial ends of said central and outer tubes and in electrical contact with said gas; and a widening of the separation between said central and outer tubes; and said first and second electrodes substantially filling the widened separation.

4. The flashlamp of claim 1 wherein said energizing means includes means for producing pulsed emission by said gas at a rate of at least two thousand Hz.

5. The flashlamp of claim 1 wherein said energizing means provides 0.5 to 2 joules of energy to said gas per centimeter of axial length.

6. The flashlamp of claim 1 wherein the axial length of said discharge path is 15 to 46 centimeters in length.

7. The flashlamp of claim 1 wherein the axial thickness of said discharge path is approximately 1 millimeter.

8. The flashlamp of claim 1 wherein said discharge path has an inner circumference of approximately 3 to 5 millimeters.

9. The flashlamp of claim 1 wherein said gas includes xenon.

* * * * *